US006089554A

United States Patent [19]

Berardino

[11] Patent Number: 6,089,554

[45] **Date of Patent: *Jul. 18, 2000**

[54] PORTABLE WORK PLATFORM

[76] Inventor: John Berardino, 408 Berkshire, Oak Park, Ill. 60302

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,422

[22] Filed: Sep. 16, 1997

[51] Int. Cl.[7] ..... B25B 1/04

[52] U.S. Cl. ..... 269/130; 269/97; 269/98; 269/131

[58] Field of Search ..... 269/130, 131, 269/132, 97, 98, 902

[56] References Cited

U.S. PATENT DOCUMENTS

| | | | |
|---|---|---|---|
| 1,213,270 | 1/1917 | Sabbow . | |
| 1,760,803 | 5/1930 | Wirth . | |
| 1,820,315 | 8/1931 | Miller . | |
| 2,431,589 | 11/1947 | Shuler | 269/131 |
| 2,581,027 | 6/1949 | Keest . | |
| 4,303,145 | 12/1981 | Vasquez . | |
| 5,405,125 | 4/1995 | Gartland | 269/51 |

FOREIGN PATENT DOCUMENTS

| | | |
|---|---|---|
| 2161529 | 1/1986 | United Kingdom . |

*Primary Examiner*—Timothy V. Eley
*Assistant Examiner*—Benjamin M. Halpern
*Attorney, Agent, or Firm*—Sonnenschein Nath & Rosenthal

[57] ABSTRACT

A portable work platform is provided for attachment to a stationary object such as a ladder. The platform includes a frame, a clamp to retain the frame to a stationary object, a vise for retaining a work piece and a guide for retaining the free end of an elongate work piece.

4 Claims, 3 Drawing Sheets

PORTABLE WORK PLATFORM

The present invention relates to a portable work platform which can be attached to a ladder or the like.

BACKGROUND OF THE INVENTION

Craftsmen, such as pipe fitters and other tradesmen often require a ladder or the like to reach a work site. In such circumstances, the tradesmen may be required to make several trips up and down ladders, moving a work piece back and forth between the work site and a work bench to prepare a work piece for use at the site. Frequently, the tradesmen must carefully make minor modifications to the work piece to fit the site, and the trips up and down the ladder and to and from the work bench can greatly protract the time consumed in preparing the work piece for use. It would, therefore, be desirable, to provide a work platform which could be attached to a ladder or to another stationary object located near a work site for performing simple functions to a work piece.

SUMMARY OF THE INVENTION

Briefly, the present invention is embodied in a portable work platform for use in conjunction with a step ladder for other relatively stationary structures near a work site. The portable work platform includes a frame defining a planar work surface, and a clamp for attaching the portable work table to a stationary structure, such as a leg of a ladder. In the preferred embodiment, the clamp is U-shaped and sized to fit around the leg of a ladder with a screw rotatable by a handle for moving a clamping member against the structure around which the U-shaped member is fitted.

The portable work platform further includes a vise at one side of the frame for removably retaining a work piece therein. At the side of the frame opposite the vise is a guide such that an elongate work piece which is fitted into the vise may be positioned across the guide. In the preferred embodiment, the vise includes a flexible elongate retailing member or strap which can be wrapped around a work piece and secured to retain a plurality of sizes of work pieces in the vise.

GENERAL DESCRIPTION OF THE DRAWINGS

A better and more complete understanding of the present invention will be had from a reading of the following detailed description taken in conjunction with the accompanying drawings wherein.

DETAILED DESCRIPTION OF THE PREFERRED EMBODIMENT

Figure 1:
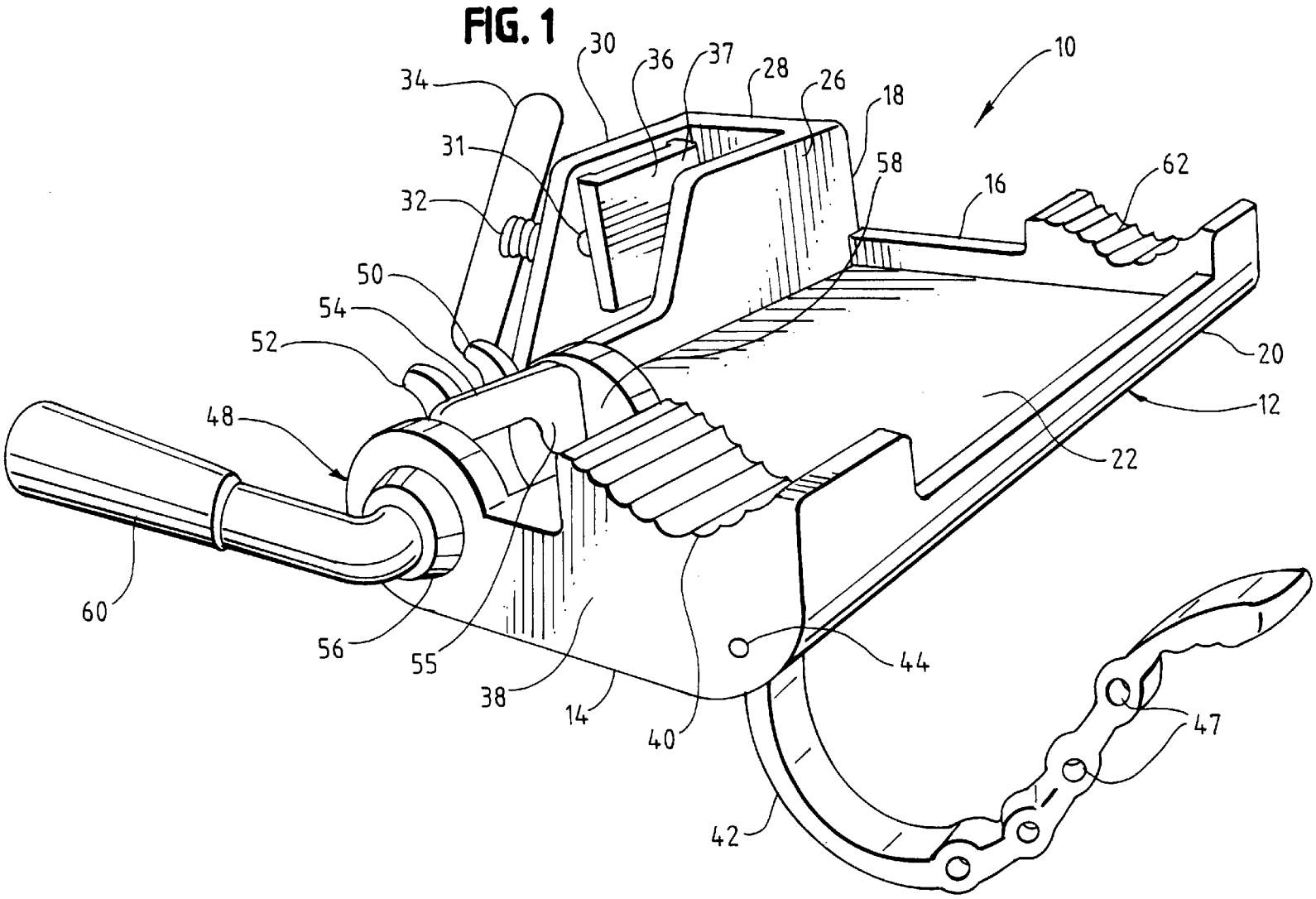
FIG. 1 is an isometric view of a work platform in accordance with the present invention.
Figure 2:
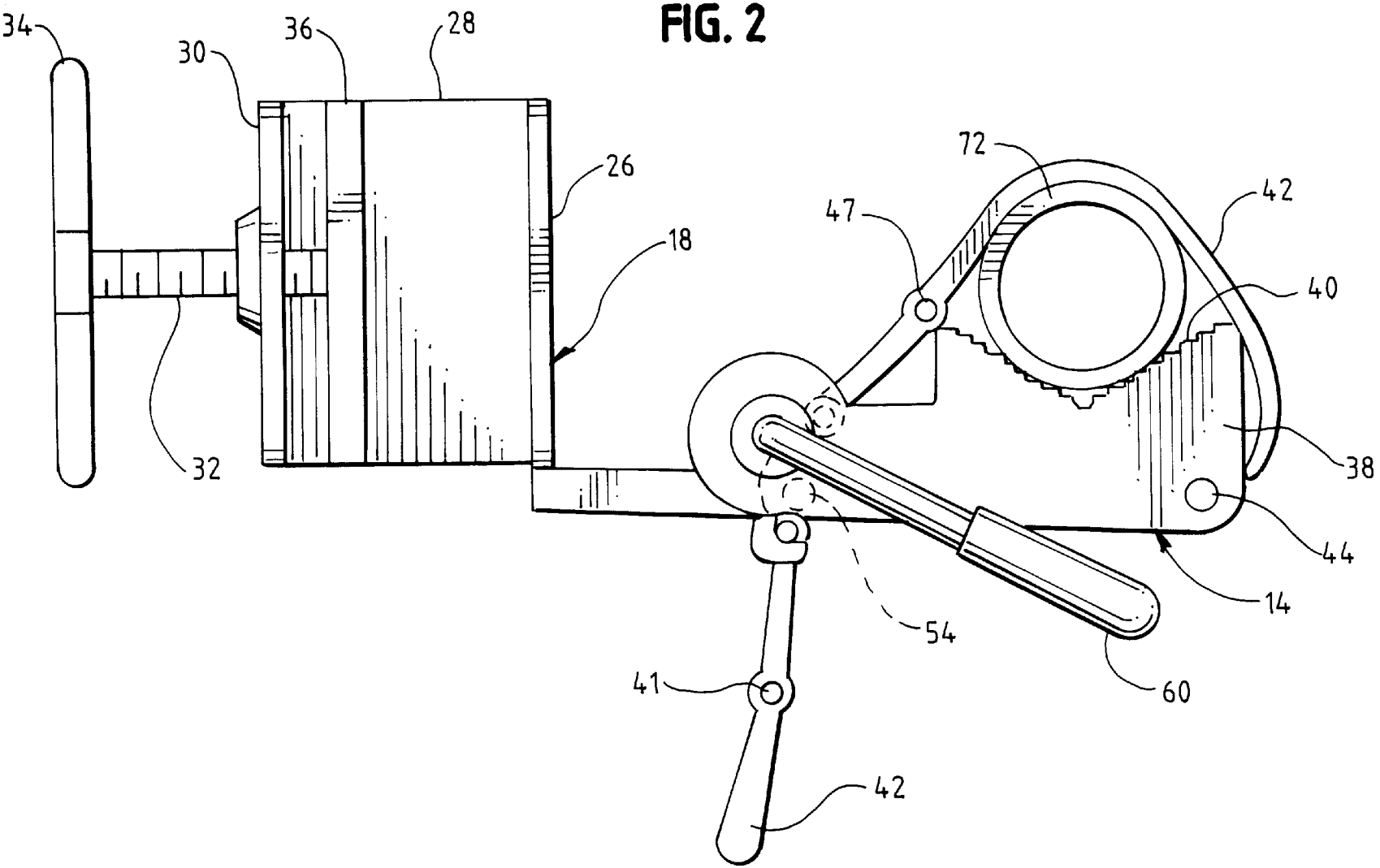
FIG. 2 is an end view of the work platform shown in FIG. 1 with a work piece locked therein.
Figure 3:
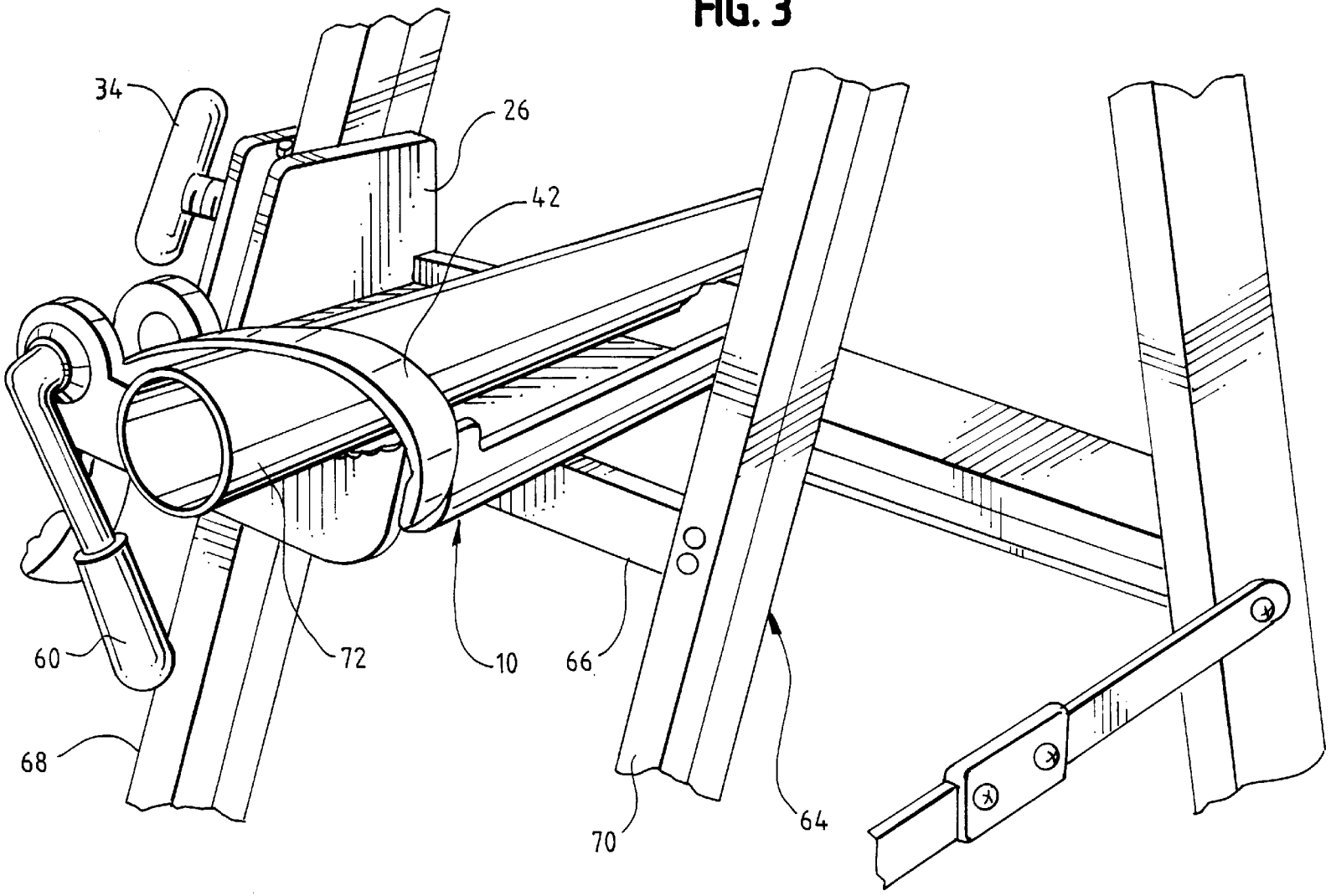
FIG. 3 is a perspective view of the work platform shown in FIG. 1 attached to a ladder and retaining a work piece therein.

Referring to FIGS. 1–3, a work platform 10 has a frame 12 including a first end member 14, a second end member 16, a first side member 18 and a second side member 20. Extending across the frame 12 is a planar floor 22.

A portion of the first side member 18 adjacent the second end member 16 includes a broad surface area 26, and extending in axial alignment with the second end member 16 and outward therefrom is an arm 28. At the distal end of arm 28 is a transverse member 30 positioned such that the enlarged portion 26, the arm 28 and the transverse member 30 form a U-shaped structure.

Extending through a threaded hole 31 in the transverse member 30, is a threaded screw 32 and on the outer end of the screw 32 is a handle 34. The distal end of the screw 32 is rotatably attached to a rectangular clamping plate 36. One straight side 37 of the clamping plate 36 is positioned adjacent the planar side of transverse member 30 such that the clamping plate 36 will not rotate with the screw 32.

Along the first end member 14 is a vise 38 which includes a V-shaped serrated rack 40 into which a work piece can be positioned. A strap 42 made of any appropriate material, such as a firm rubber, is adapted for extending over the rack 40 for retaining a work piece therebetween. One end of the strap 42 is connected at one side of the rack 40 by a pin 44 extending through a pair of opposing eyes located on the second side member 20 below the level of the floor 22, one of which 46 is visible. Extending through the strap 42 are a plurality of spaced apart pins 47—47 such that the ends of the pins 47—47 extend outward a short distance beyond the sides of the strap 42.

At the other side of the rack 40 is a vise lock 48 for adjustably retaining the free end of the strap 42. In the preferred embodiment, the lock 48 has a pair of rotatable claws 50, 52 mounted on an off center arm 54 which is mounted across the ends of offset legs, one of which, 55, is visible in FIG. 1. Each of the legs 55 has an opposite end journalled for rotation in one of two opposing mounting members 56, 58. The arm 54 and claws 50, 52 are rotated by an elongate handle 60 which is operationally connected to the leg 55 journalled in mounting member 56 and the distal end of which extends perpendicular to the length of the arm 54. Movement of the handle 60 will, therefore, rotate the claws 50, 52 from the position shown in FIG. 1 to the position shown in FIG. 2.

The claws 50, 52 on the arm 54 are spaced apart a distance a little wider than the width of the strap 42 such that when the strap 42 is positioned with one of the pins 47 under the claws 50, 52, the strap 42 will be retained by the claws.

Also, the legs 55 are spaced apart a distance which is greater than the length of the pins 47 such that the strap 42 and pins 42 can wrap around the inner surface of the offset arm 54, as shown in phantom lines in FIG. 2 and thereby form an over the center lock with an unlocked position shown in FIG. 1 and a locked position shown in FIG. 2. As can best be seen in FIG. 2, when in the locked position, the stresses placed on the expandable strap 42 are applied to retain the handle 60 in a locked position.

Positioned on the second end member 16 is a second V-shaped serrated rack 62 which is aligned with the first rack 40 such that an elongate work piece fitted in the vise 38 which extends across the second end member 16 will be supported by the second rack 62.

As best shown in FIG. 3, the platform 10 can be used in conjunction with a ladder 64 having a cross member 66 and parallel legs 68, 70. The platform 10 can be positioned such that the floor 22 thereof and the lower portions of the first and second side members 18, 22 rest upon the cross member 66 with the clamp 24 fitted around one of the legs 68. To firmly retain the platform 10 to the ladder 64, the handle 32 is turned to advance the screw 32 and thereby compress the clamping plate 36 against the leg 68.

A tradesman may use the floor 22 of the platform 10 as a work table. He may also cradle a work piece in the aligned racks 40, 62, as needed or he may retain a work piece, such as a length of pipe 72, on the platform 10 by positioning it across the racks 40, 62 and locking the strap 42 across the top thereof.

As can be seen, there is disclosed a work platform which can be mounted on a ladder, or any other substantially stable member for retaining a work piece in the proximity of a work area.

While the present invention has been described in connection with a single embodiment, it will be understood that many changes and modifications may be made without departing from the true spirit and scope of the invention, and it is intended by the appended claims to cover all such changes and modifications which come within the true spirit and scope of the invention.

What is claimed:

1. A portable work platform adapted to releasably hold a longitudinal member in a substantially horizontal position while the work platform is mounted on a vertically extending support, the work platform comprising:

a horizontally extending frame having a first end and a second end and a first side and a second side;

a releasable vise member disposed at the first end of the frame, the vise member adapted to releasably hold the longitudinal member to the frame;

a substantially vertically extending U-shaped channel integrally mounted on the first side of the frame, said U-shaped channel extending substantially at right angles to the horizontally extending frame;

the U-shaped channel having an adjustable clamping member moveable between an open position and a closed position;

the clamping member adapted to removably affix the frame to the vertically extending support when in the closed position.

2. A portable work platform in accordance with claim 1 wherein said adjustable clamping member comprises a manually rotatable screw extending through and rotatable in an end member of said U-shaped channel, said screw adapted to be moved to a position to clamp said work platform to said vertically extending support.

3. A work platform in accordance with claim 1 wherein said vise member further comprises, a rack on said frame, an elongate strap, one end of which is attached to the second side of said frame, said strap extendable across said rack and, adjustable locking means for adjusting the length of said strap extending across said rack and for locking said strap to retain a work piece between said strap and said rack.

4. A work platform in accordance with claim 1 further comprising, said releasable vise member including a first rack, guide means including a second rack on the second end of the frame, and said first rack and said second rack axially aligned to receive said longitudinal member extending therebetween.

* * * * *